US009157697B2

(12) United States Patent
Leclair

(10) Patent No.: US 9,157,697 B2
(45) Date of Patent: Oct. 13, 2015

(54) FIREARM HAND GUARD

(71) Applicant: Lamonte L. Leclair, Morgantown, IN (US)

(72) Inventor: Lamonte L. Leclair, Morgantown, IN (US)

(73) Assignee: Centurian Arms, LLC, Morgantown, IN (US)

( * ) Notice: Subject to any disclaimer, the term of this patent is extended or adjusted under 35 U.S.C. 154(b) by 0 days.

(21) Appl. No.: 14/314,718

(22) Filed: Jun. 25, 2014

(65) Prior Publication Data

US 2014/0373419 A1 Dec. 25, 2014

Related U.S. Application Data

(60) Provisional application No. 61/839,300, filed on Jun. 25, 2013.

(51) Int. Cl.
*F41C 23/00* (2006.01)
*F41C 23/16* (2006.01)

(52) U.S. Cl.
CPC ..... *F41C 23/16* (2013.01)

(58) Field of Classification Search
CPC ..... F41C 23/00; F41C 23/16; F41C 27/00
USPC ..... 42/72
See application file for complete search history.

(56) References Cited

U.S. PATENT DOCUMENTS

| | | | | |
|---|---|---|---|---|
| 5,412,895 | A * | 5/1995 | Krieger | 42/75.02 |
| 7,770,317 | B1 * | 8/2010 | Tankersley | 42/71.01 |
| 8,037,633 | B1 * | 10/2011 | Troy | 42/71.01 |
| 8,739,448 | B2 * | 6/2014 | Kimmel et al. | 42/71.01 |
| 8,904,691 | B1 * | 12/2014 | Kincel | 42/71.01 |
| 2007/0017139 | A1 * | 1/2007 | Larue | 42/75.1 |
| 2010/0095575 | A1 * | 4/2010 | Swan | 42/72 |
| 2011/0061281 | A1 * | 3/2011 | Kapusta et al. | 42/71.01 |
| 2011/0247254 | A1 * | 10/2011 | Barnes | 42/71.01 |
| 2012/0124880 | A1 * | 5/2012 | Leclair | 42/71.01 |
| 2012/0137563 | A1 * | 6/2012 | Ubl et al. | 42/75.03 |
| 2012/0180358 | A1 * | 7/2012 | Samson et al. | 42/71.01 |
| 2012/0186123 | A1 * | 7/2012 | Troy et al. | 42/71.01 |
| 2013/0205637 | A1 * | 8/2013 | Patel | 42/75.02 |
| 2014/0026459 | A1 * | 1/2014 | Yan et al. | 42/71.01 |
| 2014/0130390 | A1 * | 5/2014 | Geissele | 42/71.01 |

FOREIGN PATENT DOCUMENTS

WO WO 2013010515 A1 * 1/2013 ..... F41C 23/16

* cited by examiner

*Primary Examiner* — Gabriel Klein
(74) *Attorney, Agent, or Firm* — Gary L. Loomis; G.L. Loomis & Associates., Inc.

(57) ABSTRACT

The present invention describes a firearm hand guard assembly attachable to a threaded firearm receiver wherein it surrounds the firearm barrel distally along the longitudinal axis of the barrel. The hand guard assembly is comprised of a threaded barrel nut component and a grip component configured such that when the hand guard assembly is attached to the firearm receiver, the sole direct contact between the firearm and the hand guard assembly is the contact between the barrel nut and the firearm receiver threads.

7 Claims, 4 Drawing Sheets

FIREARM HAND GUARD

RELATED APPLICATION DATA

This application claims priority under 35 U.S.C. §119 to U.S. Provisional Application Ser. No. 61/839,300 filed Jun. 25, 2013, which is herein included by way of reference in its entirety.

FIELD OF THE INVENTION

The invention relates to a modular hand guard for use on a firearm.

BACKGROUND OF THE INVENTION

Hand-held firearms usually require some type of hand guard or hand guard so that the operator can safely hold the firearm as it is fired. The hand guards currently available in the firearms industry have inherent design problems. Many firearms are operated in automatic or semiautomatic modes and have a tendency to heat extensively so that hand guards attached directly to the barrel can produce hand burns to the operator. The heat generated by the firearm barrel transfers directly to any components it contacts, thereby directly transferring heat sufficient to burn hands as well as to impair or destroy attached electrical devices. Further compounding this problem is the requirement that gun barrels be extra heavy to support the added weight attached by means of the collars. This in turn means more cantilevered stress on the barrel where it is joined with the firearm's aluminum receiver. The combination of heat and the barrel weight tend to pull the barrel chamber out of alignment with the bolt lead, thereby causing bolt lug and extractor failure. In addition, anything attached directly to the barrel of a firearm can have a tendency to alter the barrel slightly and any alterations can adversely affect the accuracy of the firearm.

U.S. Pat. Nos. 6,490,822 and RE39,465 to Swan describe a handgrip or hand guard in the form of a receiver sleeve attached to the top of a firearm upper receiver wherein the sleeve has an upper hand guard piece attached thereto and a bottom hand guard piece fitted about the bottom of the gun barrel and is attached to the upper hand guard piece. Such a configuration additionally requires a special U-shaped supporting yoke inserted about and secured to the barrel nut at the rearward end of the upper hand guard piece to which the modular sleeve is attached. However, due to U-shape design of the yoke the U-shaped yoke can only engage a portion of the barrel nut and therefore may not provide adequate support for hand guard components which will be supported from the yoke and barrel nut combination. Therefore, in these instances, this style hand guard may not suitably protect or aid a user of the firearm.

U.S. Pat. No. 7,216,451 and published United States Patent Application 2007/0261285 to Troy describes a modular hand grip for use on a firearm that includes an upper portion, a lower portion and a coupling assembly wherein a plurality of lug rails having a plurality of gaps therein project from an inner surface of the upper portion at opposing sides and proximate edges thereof, wherein the lugs can engage in the gaps in the lug rails of the lower portion. United States Patent Application US 2012/0124880 to Leclaire describes a firearm hand guard assembly attachable to a firearm upper receiver and surrounding the firearm barrel distally along the longitudinal axis without touching the barrel. The hand guard assembly of Leclaire comprises an upper component and a lower component of essentially equal lengths, wherein the upper component and lower component are attached to one another with a firearm barrel disposed therein, the sole contact between the firearm and the hand guard assembly is the contact between the firearm barrel nut and the inner surfaces of the proximal end of the hand guard assembly.

U.S. Pat. Nos. 6,490,822, RE 39,465, 7,216,451 and published United States Patent Applications 2007/0261285 and 2012/0124880 are hereby included by way of reference.

In view of the foregoing disadvantages inherent in the known types of devices now present in the prior art, the present invention provides a hand guard in the form of an easily attachable dual component receiver sleeve. As such, the general purpose of the present invention, which will be described subsequently in greater detail, is to provide a new and improved interface means for firearms which will isolate the barrel while providing various capabilities for mounting and integrating optics, lasers, sensors and the like.

Therefore, a need exists for systems and methods for providing a hand guard and accessory attachment device for a firearm, for example, a rifle.

The present invention addresses problems and deficiencies inherent in the hand guards of the art and presents improvements.

Accordingly, it is an object the present invention to provide a new and improved hand guard for a firearm.

Another object of the present invention is to provide a hand guard, which imparts increases stability when attached to the barrel of a firearm.

These and other objects of the present invention will be apparent from a review of the following specification and accompanying drawings.

SUMMARY OF THE INVENTION

Figure 1A:
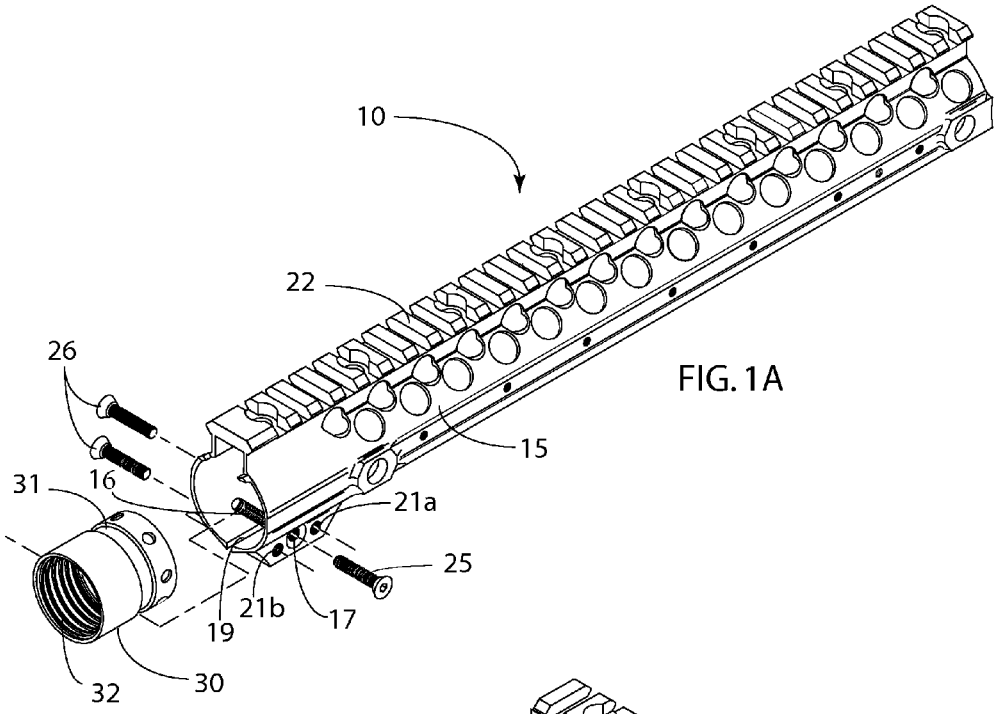
FIG. 1A is an exploded isometric view from the proximal end of a hand guard assembly of the present invention depicting the relationship between the grip component, the barrel nut component, the barrel nut retaining bolt and the locking bolts.

The present invention describes firearm hand guard assembly which, when attached to a firearm receiver and barrel, completely surrounds the barrel and extends distally to a position just short of the barrel front sight. The hand guard assembly is comprised of a grip component having a proximal end and a distal end; a barrel nut component wherein the guard component is configured to be engageable with the barrel nut to provide a hand guard having a lumen that surrounds the barrel of a firearm when affixed to the firearm by means of the barrel nut component. The barrel nut component is retained within the proximal end of the grip component by a threaded retaining bolt and may be further secured one or more locking bolts, which prevent rotation of the barrel nut. In such embodiments the barrel nut is threaded onto the firearm receiver assembly like a conventional barrel nut in the usual manner.

In certain embodiments the barrel nut comprises a slot circumferentially disposed about outer surface and configured to be engaged by the retaining bolt when the barrel nut is disposed within the proximal end of the grip component. In such embodiments the proximal end of the grip component is configured to define an opening through which the retaining bolt can pass to engage the circumferential slot in the barrel nut. In certain embodiments the interior surface of the hole is threaded to match the threads of the retaining bolt.

In certain embodiments the proximal end of the grip component is configured to define a compressible gap or space. In such embodiments the proximal end of the grip component is further configured to define one or more threaded openings to accept one or more locking bolts that function to compress the gap upon tightening and further secure the barrel nut within the grip component particularly to prevent rotation. In certain preferred embodiments at least a portion of the barrel nut is internally threaded to match the threads on the receiver of the particular firearm to which it is to be attached. By this arrangement the only contact between the grip component and the firearm to which it is attached is the contact of the grip component proximal end with the barrel nut.

In certain embodiments the grip component also comprises one or more rails configured for attachment or incorporation of ancillary equipment. In certain preferred embodiments the grip component comprises one such rail while other preferred embodiments the grip component comprises two or three such rails. Yet certain other embodiments the grip component comprises four rails, wherein such embodiments are commonly referred to as quad-rail or quad-type systems. Such rails provides capabilities for mounting and integrating ancillary equipment such as optics, lasers, sensors and the like.

In certain embodiments the top of the proximal end of the grip component comprises a notch, which may function to prevent rotation of the grip component with respect to the firearm receiver. In such embodiments, wherein the notch function is not required, a notch insert configured to completely fill the notch when inserted therein may be employed.

DETAILED DESCRIPTION

Embodiments of the present invention disclose a hand guard assembly for a firearm, wherein the firearm has minimally a receiver with a stock and barrel attached thereto, said barrel defining the forward or distal portion of the firearm and said stock defining the rearward or proximal portion of the firearm. Such a firearm has a longitudinal axis being defined as horizontal and extending distally from the firearm stock. The receiver has a distal end and a proximal end, wherein the receiver proximal end is attached to the stock and the receiver distal end is connected to the barrel by means of a barrel nut.

Generally, the hand guard assembly is reversibly attachable to a firearm wherein the firearm has an externally threaded receiver and a barrel having longitudinal axis and front site. The hand guard assembly comprises: a barrel nut component comprising a barrel nut proximal end, a barrel nut distal end, a barrel nut wall, a barrel nut outer surface and a barrel nut luminal surface, wherein the barrel nut component luminal surface is threaded to match the external threads of the firearm receiver such that the barrel nut component is reversibly attachable to the firearm receiver. The hand guard assembly further comprises a grip component having a one-piece grip component body with a longitudinal axis, a proximal end, a distal end, an outer surface and a lumen having a luminal surface. The grip component body proximal end and the barrel nut component are each configured to be attachable to one another; such that, when the barrel nut component is attached to the firearm receiver and the grip component body distal end is attached to the barrel nut component, the hand guard assembly extends from the barrel nut to a position at or near the firearm barrel front sight to define a generally tubular sleeve that completely surrounds the firearm barrel along the longitudinal axis; and wherein the sole direct contact between the firearm and the hand guard assembly is the contact between the barrel nut threads and the external firearm receiver threads.

In certain embodiments the hand guard assembly further comprises a grip component retaining bolt and in such embodiments the barrel nut outer surface comprises a circumferentially disposed barrel nut groove at or near the barrel nut distal end which is engageable by the grip component retaining bolt and the grip component body proximal end is configured to define a grip component retaining bolt channel disposed perpendicularly to the grip component body longitudinal axis and extending therethrough such that when the barrel nut is disposed within the proximal end of the grip component body lumen, and the grip component retaining bolt is disposed within the grip component retaining bolt channel, the grip component retaining bolt engages the barrel nut groove and functions to attach the grip component to the barrel nut. In certain other embodiments, the grip component retaining bolt is at least partially threaded and the grip component retaining bolt channel is at least partially threaded to match the threads of the grip component retaining bolt.

In certain embodiments of the hand guard assembly the grip component body proximal end is configured to define a compressible gap or space and is further configured to define one or more threaded openings spanning the compressible gap and is configured to accept one or more threaded locking bolts that function to compress the gap to further secure the barrel nut to the grip component.

In certain other embodiments the hand guard assembly the grip component body proximal end comprises a notch, which is configured to prevent rotation of the grip component with respect to the firearm receiver to which it is attached. Additionally in certain other embodiments the hand guard assembly further comprises a removedly attachable notch insert configured to completely fill the notch when attached therein.

In certain embodiments the hand guard assembly comprises one or more hand guard assembly setscrews comprising setscrew proximal ends and setscrew distal ends, wherein the setscrews are insertable through one or more threaded setscrew openings extending through the grip component body wall at the grip component body proximal end and configured to mate with the hand guard assembly setscrews. Additionally in certain other related embodiments the barrel nut outer surface comprises one or more barrel nut indentations or dimples configured to accept the setscrew distal ends. Such an arrangement functions to prevent the relative rotation of the grip component body and the barrel nut. Optionally in such embodiment the outer surface of barrel nut may comprise one or more hand barrel nut indentations configured to accept the distal ends of the setscrews respectively and functioning to further secure the grip component body to the barrel nut.

In certain embodiments of the hand guard assembly the outer surface of the grip component comprises one or more rails extending along the longitudinal axis and configured for attachment or incorporation of ancillary equipment. Additionally in certain other related embodiments the outer surface of the grip component comprises two to four rails extending along the longitudinal axis and configured for attachment or incorporation of ancillary equipment. Such ancillary equipment may include, but is not limited to, optical devices, laser devices, sensors and the like.

Preferred embodiments of the present invention are firearm hand guard assemblies which, when attached to a firearm receiver, completely surround the barrel and extend distally to a position just short of the barrel front sight. In FIG. 1A is illustrated an exploded isometric view from the proximal end of a hand guard assembly 10 illustrating the relationship between a generally cylindrical grip component body 15 having an outer surface, a luminal surface (lumen), a proximal end and a distal end; a barrel nut component 30 having a luminal surface and an outer surface; a barrel nut retaining bolt 25 and locking bolts 26.

The barrel nut 30 is configured to define a barrel nut groove 31 circumferentially disposed about the outer surface; wherein the inner surface of the proximal end of the grip component body 15 is configured to define a barrel nut-retaining bolt channel 16 disposed perpendicularly to the longitudinal axis of the grip component body 15 and extending through the wall of the grip component body 15 on at least one side to define a first barrel nut-retaining bolt opening 17 wherein either or both the barrel nut-retaining bolt channel 16 and the a first barrel nut-retaining bolt opening 17 may be threaded to mate with threads of barrel nut-retaining bolt 25. In such embodiments the barrel nut-retaining bolt 25 engages the barrel nut groove 31 when the barrel nut 30 is disposed within the proximal end of the grip component 15 and the barrel nut-retaining bolt 25 is fully disposed within the grip component body 15. In certain embodiments the barrel nut groove 31 is at least partially threaded to mate with the threads of the barrel nut-retaining bolt 25.

Figure 1B:
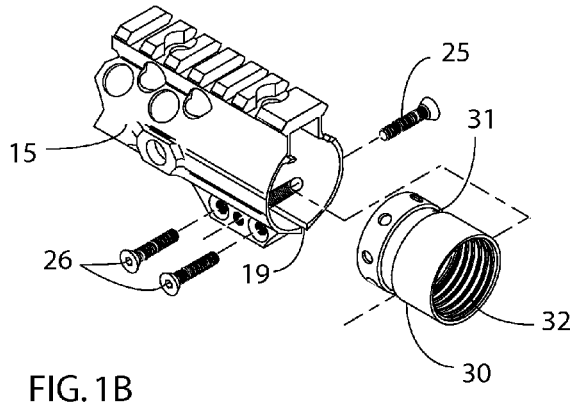
FIG. 1B is a partial exploded isometric view from the proximal end of the hand guard assembly of FIG. 1A shown from the side opposite the side depicted in FIG. 1A.

In the embodiment depicted in FIGS. 1A and 1B the nut-retaining bolt channel 16 also extends through the wall of the tubular grip component 15 on the side opposite first barrel nut-retaining bolt opening 17 to define a second barrel nut-retaining bolt opening 18 which is threaded to mate with threads of the barrel nut-retaining bolt 25. Also as is illustrated in FIG. 3B, in such embodiments the luminal surface 32 of the barrel nut 30 comprises threads that mate with the external threads 56 of the receiver assembly 55 of the firearm to which it is attachable such that the barrel nut 30 can be threaded onto the firearm receiver assembly like a conventional barrel nut.

Also in the embodiment depicted in FIGS. 1A and 1B the proximal end of the grip component body 15 is configured to define a grip component compressible gap 19 and the proximal end of the grip component is further configured to define one or more threaded openings 21*a* and 21*b* to accept one or more grip component locking bolts 26 that function to compress the gap 19 upon tightening thereby functioning to further secure the barrel nut 30 within the grip component body 15 to prevent relative rotation of the components. In such embodiments at least a portion of the barrel nut 30 comprises internal threads 31 that match threads on the receiver of the particular firearm to which it is to be attached. By this arrangement the sole contact between the grip component and the firearm to which it is attached is the contact of the threaded barrel nut lumen 32 of barrel nut 30 with external threads of the firearm receiver assembly.

The particular embodiment depicted in FIGS. 1A and 1B further comprises a rail 22 disposed longitudinally along the top surface of the grip component body 15 configured for attachment or incorporation of ancillary equipment. However other embodiments may incorporate a plurality of rails extending along the longitudinal axis the grip component body, wherein such rails may be configured for attachment or incorporation of ancillary equipment.

Figure 2:
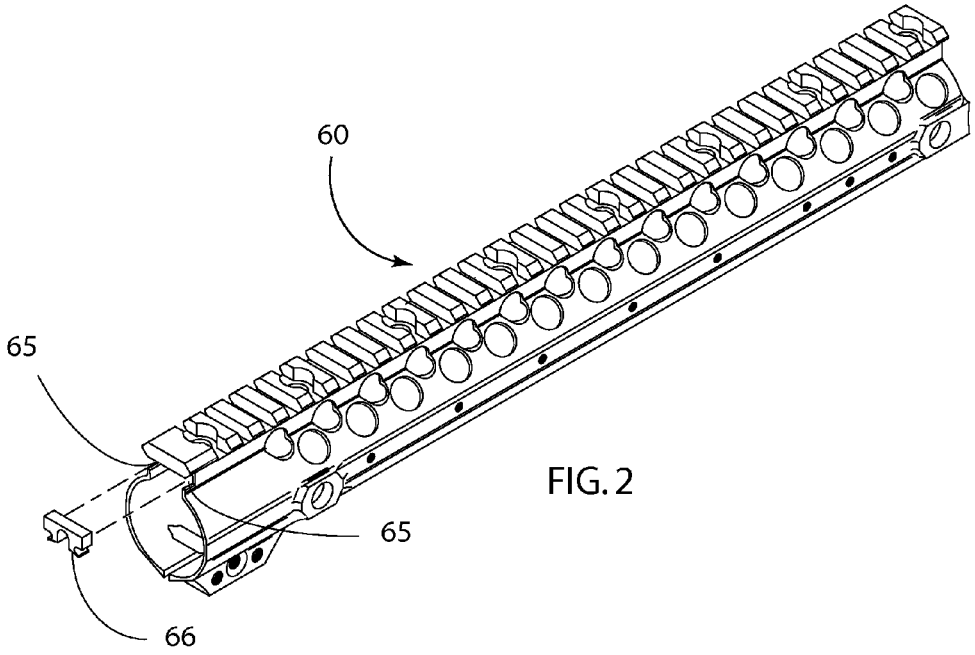
FIG. 2 is an isometric view from the proximal end of an embodiments the grip component of a hand guard assembly of the present invention.

In FIG. 2 is depicted a grip component body 60 of a hand guard assembly of the present invention, wherein the proximal end is configured to define a grip component body notch 65 which functions to prevent rotation of the grip component with respect to the firearm receiver of suitably configured firearm receivers to which it is attached. In other embodiments, wherein function of the grip component body notch 65 is not required, a grip component body notch insert 66B, which is configured to completely fill the grip component body notch 65 when inserted therein, may be employed.

Figure 3A:
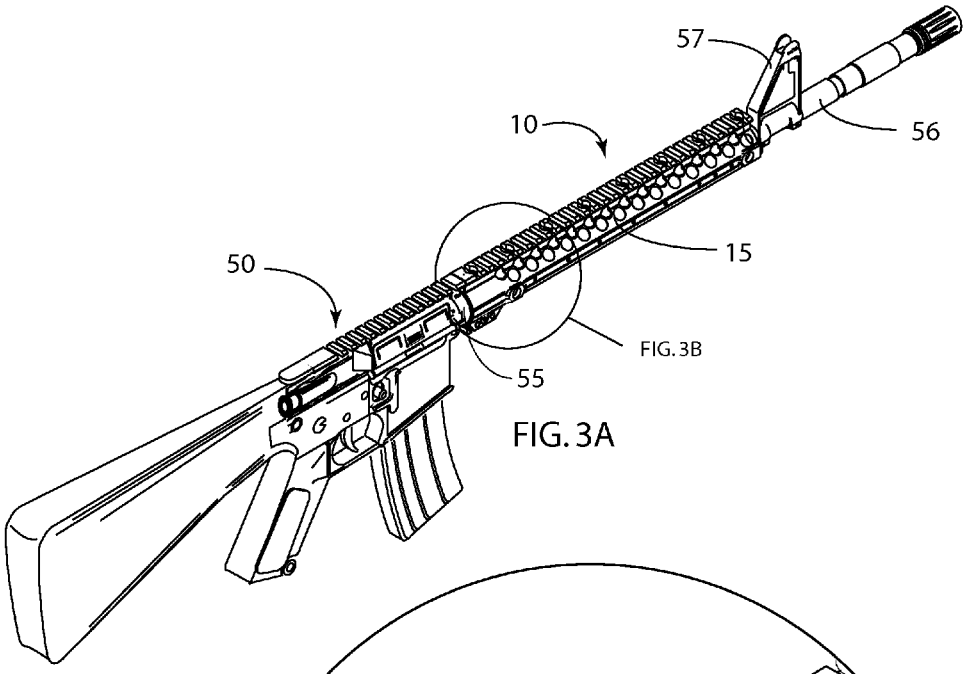
FIG. 3A is an isometric view of the hand guard of FIGS. 1A and 1B attached to a firearm.
Figure 3B:
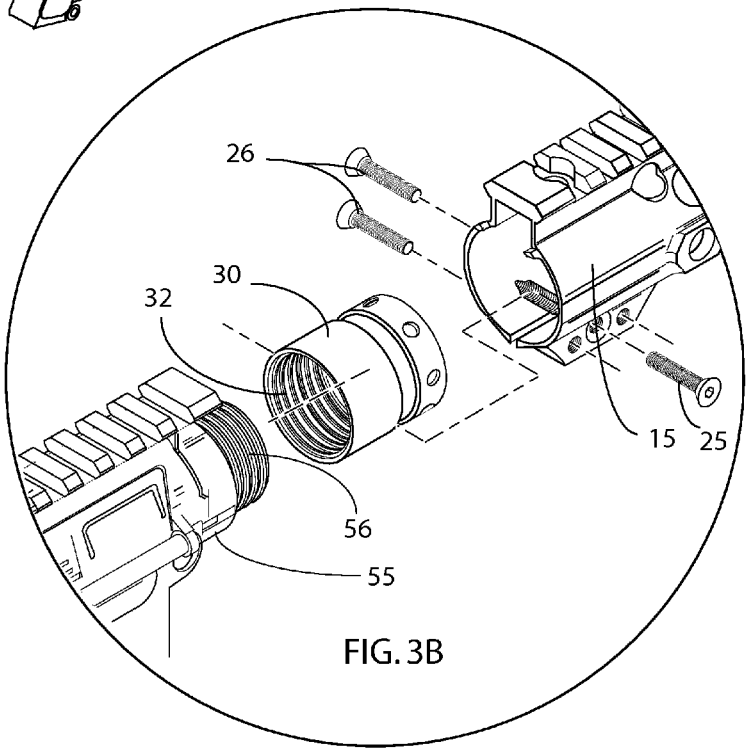
FIG. 3B is an exploded isometric view of the proximal end of the hand guard assembly of FIGS. 1A and 1B attached to a firearm.

In FIG. 3A is depicted the hand guard assembly 10 attached to a firearm 50 clearly illustrating the attached to a firearm receiver 55, wherein the grip component body 15 completely surrounds the firearm barrel 56 and extend distally to a position just short of the barrel front sight 57. In FIG. 3B is depicted and exploded view illustrating the relationship between the firearm receiver 55, the barrel nut 30 and the proximal end of the grip component body 15 as well as the barrel nut-retaining bolt 25 and locking bolts 26.

Figure 4:
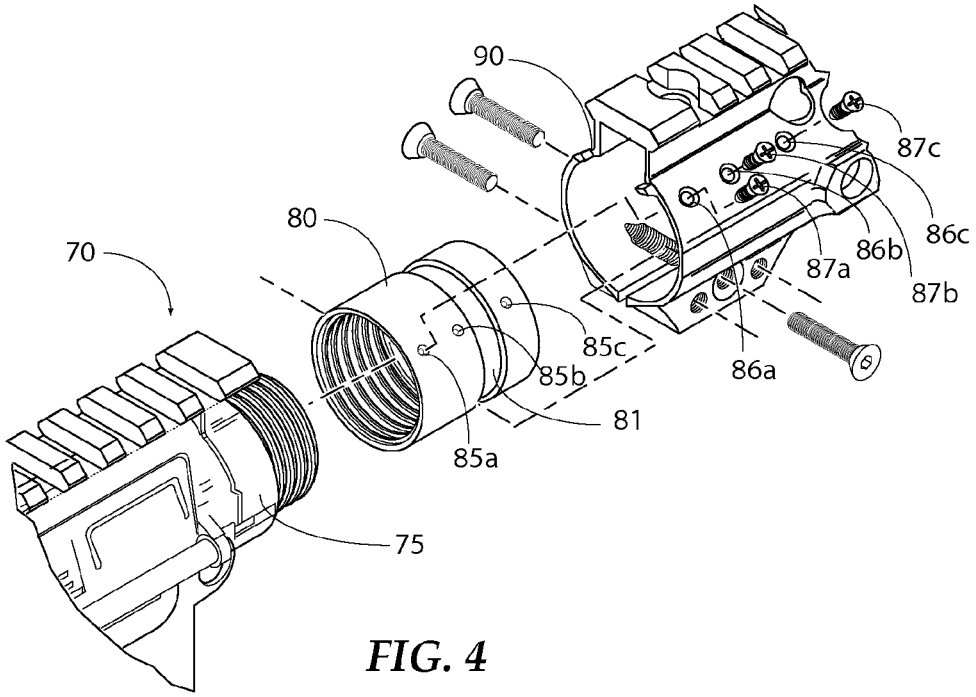
FIG. 4 is and exploded isometric view proximal end of a hand guard assembly of the present invention attached to the receiver of a firearm.

In FIG. 4 is depicted an embodiment of a hand guard assembly of the present invention wherein the grip component body 90 comprises threaded setscrew openings 86*a*, 86*b* and 86*c* extending through the wall perpendicular to the longitudinal axis of the grip component body 90 and matchingly threaded hand guard assembly setscrews 87*a*, 87*b* and 87*c*. In such embodiments, when the grip component body 90 is attached to barrel nut 80 and setscrews 87*a*, 87*b* and 87*c* are inserted into setscrew openings 86*a*, 86*b* and 86*c* and tightened, the arrangement functions to prevent the relative rotation of grip component body 90 and barrel nut 80. Additionally in this embodiment the outer surface of barrel nut 80 comprises barrel nut indentations 85*a*, 85*b* and 85*c* configured to accept the distal ends of setscrews 87*a*, 87*b* and 87*c* respectively. Such an arrangement functions to further secure the grip component body 90 to the barrel nut 80.

Preferred materials of construction for components of embodiments extremity support apparatus of the present invention include, but are not limited to, metal such as aluminum or steel as well as combinations thereof. The most preferable material is aluminum or an aluminum alloy. Use of such metals decreases the likelihood of rusting and/or pitting of components and increases the ease of cleaning. Also use of such materials imparts a substantial durability and sturdiness to the apparatus with minimum weight.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

We claim:

1. A hand guard assembly reversibly attachable to a firearm, wherein the firearm comprises a firearm receiver comprising external firearm receiver threads and a firearm barrel comprising a firearm barrel longitudinal axis and a firearm barrel front sight; wherein the hand guard assembly comprises:

a barrel nut component comprising a barrel nut proximal end, a barrel nut distal end, a barrel nut wall, a barrel nut outer surface and a barrel nut luminal surface, wherein the barrel nut component luminal surface comprises barrel nut threads that match the external firearm receiver threads such that the barrel nut component is reversibly attachable to the firearm receiver; and a grip component comprising a one-piece grip component body having a grip component body longitudinal axis, a grip component body proximal end, a grip component body distal end, a grip component body wall, a grip component body outer surface and a grip component body lumen having a grip component body luminal surface; wherein the grip component body proximal end is configured to define a compressible gap disposed along the longitudinal axis and is further configured to define one or more threaded openings spanning the compressible gap and configured to accept one or more threaded grip component locking bolts that function to compress the gap to further secure the barrel nut to the grip component;

wherein the grip component body proximal end and the barrel nut component are each configured to be attachable to one another; such that, when the barrel nut component is attached to the firearm receiver and the grip component body proximal end is attached to the barrel nut component, the hand guard assembly extends from the barrel nut to a position at or near the firearm barrel front sight to define a generally tubular sleeve that completely surrounds the firearm barrel along the firearm barrel longitudinal axis; wherein, when the hand guard assembly is attached to the firearm, the sole direct contact between the firearm and the hand guard assembly is the contact between the barrel nut threads and the external firearm receiver threads;

wherein the grip component body proximal end comprises a notch, which is configured to prevent rotation of the grip component with respect to a firearm receiver to which it is attached; and wherein the hand guard assembly further comprises a removedly attachable notch insert configured to completely fill the notch when inserted therein to disable the notch from preventing rotation of the grip component with respect to a firearm receiver to which it is attached.

2. The hand guard assembly of claim 1 further comprising a grip component retaining bolt; and wherein the barrel nut outer surface comprises a circumferentially disposed barrel nut groove at or near the barrel nut distal end which is engageable by the grip component retaining bolt; and wherein the grip component body proximal end is configured to define a grip component retaining bolt channel disposed perpendicularly to the grip component body longitudinal axis and extending therethrough such that when the barrel nut is disposed within the proximal end of the grip component body lumen, and the grip component retaining bolt is disposed within the grip component retaining bolt channel, the grip component retaining bolt engages the barrel nut groove and functions to attach the grip component to the barrel nut.

3. The hand guard assembly of claim 2 wherein the grip component retaining bolt is at least partially threaded and the grip component retaining bolt channel is at least partially threaded to match the threads of the grip component retaining bolt.

4. The hand guard assembly of claim 1 wherein the outer surface of the grip component comprises one or more rails extending along the longitudinal axis and configured for attachment or incorporation of ancillary equipment.

5. The hand guard assembly of claim 1 wherein the outer surface of the grip component comprises two to four rails extending along the longitudinal axis and configured for attachment or incorporation of ancillary equipment.

6. The hand guard assembly of claim 1 comprising one or more hand guard assembly setscrews comprising setscrew proximal ends and setscrew distal ends, wherein the setscrews are insertable through one or more threaded setscrew openings extending through the grip component body wall at the grip component body proximal end and configured to mate with the hand guard assembly setscrews.

7. The hand guard assembly of claim 6 wherein the barrel nut outer surface comprises one or more barrel nut indentations configured to accept the setscrew distal ends.

* * * * *